US006206741B1

(12) United States Patent
Matsuda

(10) Patent No.: US 6,206,741 B1
(45) Date of Patent: Mar. 27, 2001

(54) EXHAUST OUTLET STRUCTURE FOR PERSONAL WATERCRAFT

(75) Inventor: Yoshimoto Matsuda, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 09/338,091

(22) Filed: Jun. 23, 1999

(30) Foreign Application Priority Data

Jun. 30, 1998 (JP) ..... 10-183655

(51) Int. Cl.[7] ..... B63H 21/32
(52) U.S. Cl. ..... 440/89
(58) Field of Search ..... 440/89; 181/235; 114/183 R, 184, 185

(56) References Cited

U.S. PATENT DOCUMENTS

| | | | | |
|---|---|---|---|---|
| 4,498,876 | * | 2/1985 | Zemlicka | 440/89 |
| 4,779,704 | * | 10/1988 | Akiyama | 181/235 |
| 5,078,631 | * | 1/1992 | Harbert | 440/89 |
| 5,299,961 | * | 4/1994 | Okamoto | 440/89 |
| 5,389,022 | * | 2/1995 | Kobayashi | 440/89 |
| 5,556,314 | * | 9/1996 | Fukuda et al. | 440/89 |
| 5,561,276 | * | 10/1996 | Quartarone | 181/235 |
| 5,791,953 | * | 8/1998 | Gunderson et al. | 440/89 |
| 5,934,959 | * | 8/1999 | Inman, Sr. et al. | 440/89 |

FOREIGN PATENT DOCUMENTS

| | | | | |
|---|---|---|---|---|
| 82698 | * | 7/1981 | (JP) | 440/89 |
| 2-134000 | | 7/1990 | (JP) . | |
| 5-34100 | | 7/1993 | (JP) . | |

* cited by examiner

*Primary Examiner*—S. Joseph Morano
*Assistant Examiner*—Ajay Vasudeva
(74) *Attorney, Agent, or Firm*—Marshall, O'Toole, Gerstein, Murray & Borun

(57) ABSTRACT

A shut-off member provided on a rear end of an exhaust passage of the personal watercraft is formed to have such a shape that one of the ends of a short pipe made of nitrile rubber is flatly made, thereby including a lip portion having upper and lower side walls which come in contact with each other, and is protruded rearward and downward from a hull of the watercraft. A portion between the upper and lower side walls coming in contact with each other forms a slit to act as an exhaust port. The slit is substantially shut off based on a molding shape thereof if there is no difference between internal and external pressures of the shut-off member, and is opened against the elastic force of a surrounding flexible material depending on a differential pressure and a flow rate of an internal fluid if the internal pressure becomes higher than the external pressure.

4 Claims, 7 Drawing Sheets

EXHAUST OUTLET STRUCTURE FOR PERSONAL WATERCRAFT

BACKGROUND OF THE INVENTION

1. Field of the Invention

The present invention relates to an exhaust outlet structure for a personal watercraft. More specifically, the present invention relates to an exhaust outlet structure for discharging the exhaust gas of an engine mounted on the personal watercraft.

2. Description of the Related Art

In general, the personal watercraft is provided with an exhaust outlet for discharging an exhaust gas from an engine at a rear portion of a hull. Some personal watercrafts serve to discharge cooling water of an engine and an exhaust system together with the exhaust gas from an exhaust outlet to a rear outside by a pressure (back pressure) of the exhaust gas. However, the personal watercraft is a vehicle to plane along the water surface. Therefore, the exhaust outlet is positioned on the water surface during running and is sometimes positioned below the water surface at the time of stop. Accordingly, if the exhaust outlet is kept open, there is a possibility that the water might flow from the outside to the inside through the exhaust outlet to cause a counterflow when the engine is stopped so as to prevent the discharge of any exhaust gas.

As shown in the prior art configuration of FIG. 8, conventionally, exhaust pipes 51 and 52 constituting exhaust passages in a personal watercraft S and a water muffler 53 for noise elimination have formed a maze. First of all, the water muffler 53 is divided into right and left chambers 53*a* and 53*b* by a bulkhead 54. A communicating pipe 55 for causing the chambers 53*a* and 53*b* to communicate with each other is provided slightly above the center of the bulkhead 54. The exhaust pipe 51 connected from an engine E to the water muffler 53 has a rear end 51*a* opened in the vicinity of a central portion of the front chamber 53*a* of the water muffler 53. The exhaust pipe 52 connected from the water muffler 53 to an exhaust outlet 56 provided in a rear portion of a hull of the watercraft S has a front end 52*a* opened in the vicinity of a central portion of the rear chamber 53*b* of the water muffler 53. Furthermore, the exhaust pipe 52 extends upward from the front end 52*a* thereof through the water muffler 53, and is then curved downward and extends rearward. Thus, a countermeasure has been taken such that the water stays in the bottom of the water muffler 53 so as not to cause a counterflow to the engine side even if it flows to the inside through the exhaust outlet 56 when the engine is stopped.

Since the cooling water is mixed in the exhaust gas to perform cooling of the exhaust gas, the water muffler 53 promotes a reduction in exhaust sounds. For this reason, a duplex pipe is usually used as the exhaust pipe 51 reaching the water muffler 53, and a portion between an outer pipe and inner pipe through which the exhaust gas passes, is formed as a passage for the cooling water. A rear end of the exhaust pipe 51 is opened in the water muffler 53, and the cooling water is mixed with the exhaust gas. The bulkhead 54 has a small communicating hole 58 such that the cooling water and the exhaust gas can flow into the chambers 53*b* from the chambers 53*a*.

When the watercraft S planes, a cavity V is generated on a water surface portion in a rear part of the watercraft S as shown in FIG. 8. Consequently, reflected sounds of the exhaust gas are made by a water surface F. In some cases, a nonreturn valve (also referred to as a bellows valve) 57 having a simple structure is provided on the exhaust outlet 56 for guiding an exhaust flow to the water surface as shown by an arrow A in order to control the reflected sounds.

In the drawing, the reference numeral 59 denotes a steering handlebar, the reference numeral 60 denotes a seat on which a driver sits, and the reference numeral 61 denotes a fuel tank.

Japanese Unexamined Utility Model Applications Nos. Hei 2-134000 and Hei 5-34100 have disclosed the exhaust outlet of the personal watercraft.

The water muffler 53 forms a part of the exhaust passage, and is greatly concerned with the performance of the engine. Accordingly, it is desirable that the exhaust passage provided in the water muffler 53 should have a shape which is as simple as possible in respect of an enhancement in the output performance of the engine and simplification of a performance test in the engine.

Although the nonreturn valve 57 has some effects of controlling the reflected sounds, sealing against the water on the outside is not sufficiently performed.

SUMMARY OF THE INVENTION

In order to solve the above-mentioned problems, it is an object of the present invention to provide an exhaust outlet structure for a personal watercraft capable of effectively preventing outside water from flowing to the inside through an exhaust port of the personal watercraft and of controlling reflected sounds of an exhaust gas.

The present invention provides an exhaust outlet structure for a personal watercraft which serves to discharge an exhaust gas of an engine mounted on the personal watercraft, the exhaust outlet structure comprising a shut-off member provided on a rear end of an exhaust passage and formed of a flexible material, and an exhaust port formed at the shut-off member, which is capable of being elastically shut off and being opened by external force.

Accordingly, when the exhaust gas is not discharged, for example, the engine is stopped, the water can be prevented from flowing into the exhaust passage from the outside because the exhaust port is shut off by elasticity of a flexible material itself. However, when the engine is operated so that the exhaust gas flows through the exhaust passage, for example, a pressure in the exhaust passage becomes higher than an external pressure (usually, an atmospheric pressure). Therefore, the exhaust port is spread out against the elastic force of the flexible material so that the exhaust gas is discharged. The above-mentioned phrase "external force" includes the force caused by exhaust gas pressure.

The shut-off member protruding from a hull rearward and downward has upper and lower side walls which come in contact with each other, and a portion between the upper and lower side walls forms the exhaust port. Consequently, since the exhaust port is disposed obliquely downward, the reflected sounds can be prevented effectively. The shut-off member is formed of a flexible material. Therefore, the exhaust port can be easily formed in various shapes. In case the exhaust port of the shut-off member is formed adjacent to the water surface, the vicinity of the exhaust port of the shut-off member comes in contact with the water when the watercraft planes, the shut-off member is distorted by force of a water flow, thereby promoting opening of the exhaust port.

In the shut-off member, preferably, the upper side wall is extended more greatly than the lower side wall rearward and downward. Consequently, the upper side wall is pushed rearward by utilizing the water flow. As a result, the exhaust port can be forced open.

Furthermore, the shut-off member may have a film portion capable of shutting off the rear end of the exhaust passage, and the film portion is provided with a plurality of cuts which mutually intersect and constitute the exhaust port. Consequently, the exhaust port can be opened more easily by the internal pressure of the shut-off member.

The shut-off member protruding from a hull rearward and downward may have first and second walls, a portion between the first and second walls forms the exhaust port, and both side walls between the first and second walls reaching the exhaust port are formed to be folded so that the exhaust port closes. Thus, even if an exhaust flow rate is great, the opening area of the exhaust port can be increased correspondingly.

In this case, the first and second walls may be upper and lower side walls or right and left side walls, respectively.

Furthermore, it is preferable that a volume portion, such as a bulge, is formed on the upstream side of the exhaust port in the shut-off member. Consequently, when the water flow comes in contact with the volume portion, the shut-off member is pushed from the outside. Thus, the shut-off member is bent so that the opening of the exhaust port is promoted when operationally desired. In addition, it is possible to expect the same opening promotion function obtained by a wind pressure.

These objects as well as other objects, features and advantages of the present invention will become more apparent to those skilled in the art from the following description with reference to the accompanying drawings.

DESCRIPTION OF THE PREFERRED EMBODIMENTS

An exhaust outlet structure according to the present invention will be described below with reference to preferred embodiments illustrated in the accompanying drawings.

Figure 1:
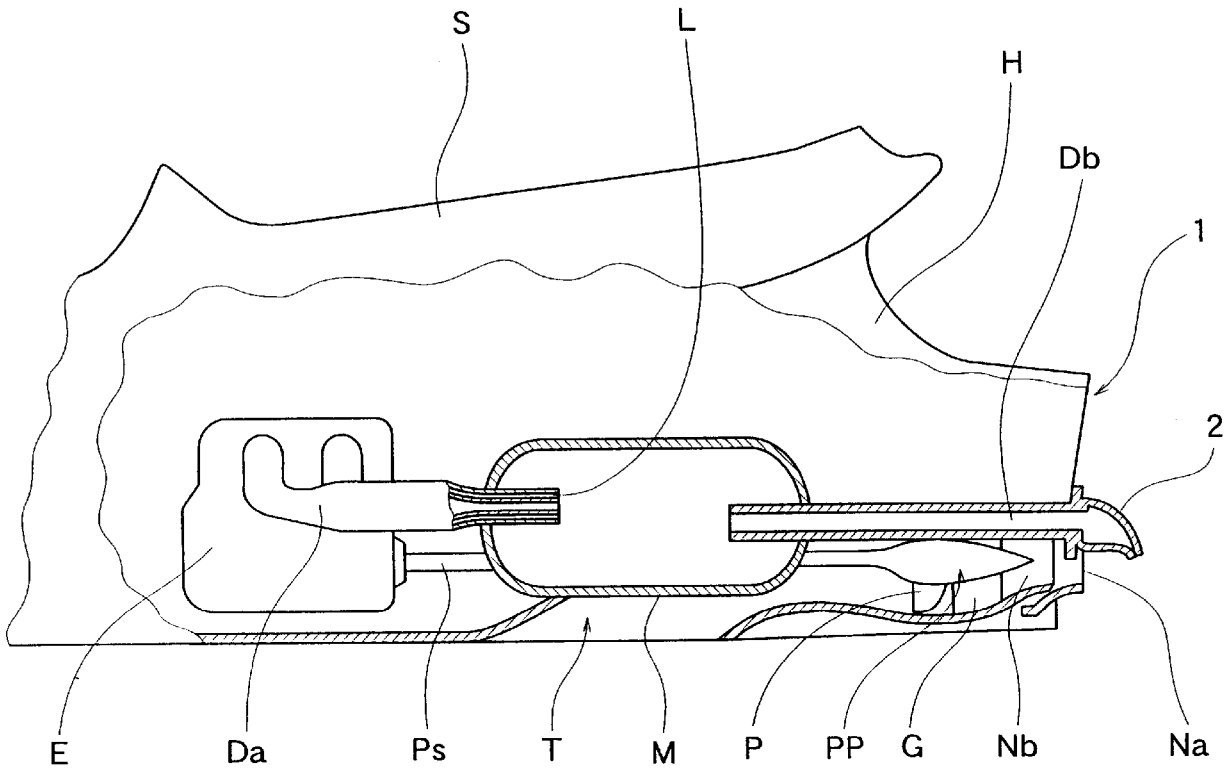
FIG. 1 is a partially sectional side view showing a rear portion of a personal watercraft to which an exhaust outlet structure according to a first embodiment of the present invention is applied.

FIG. 1 shows a rear portion of a personal watercraft S provided with an exhaust outlet structure 1 according to the first embodiment. A water muffler M is mounted on the watercraft S. A first exhaust pipe Da is connected from an engine E to the water muffler M. The first exhaust pipe Da is a duplex pipe having a cooling water passage L formed thereon. A second exhaust pipe Db is connected from the water muffler M to a rear end of the watercraft S. A shut-off member 2 is fixed to a rear end of the second exhaust pipe Db. The shut-off member 2 forms the exhaust outlet structure 1 and is made of a flexible material.

In the drawing, Ps denotes a propeller shaft which is rotated by the engine E. An impeller P forming a propulsion pump PP disposed at the rear bottom portion of a hull H is fixed to a rear end of the propeller shaft Ps. G denotes a fixed guide vane of the propulsion pump PP. Outside water is sucked through an intake T provided on the bottom of the hull H, and is pressured by the impeller P of the pump PP, and is ejected rearward of the watercraft S. Consequently, the watercraft S is caused to plane. Na denotes a steering nozzle, and serves to change the direction of a water flow discharged from a pump nozzle Nb, thereby altering the running direction of the watercraft S.

Figure 2:
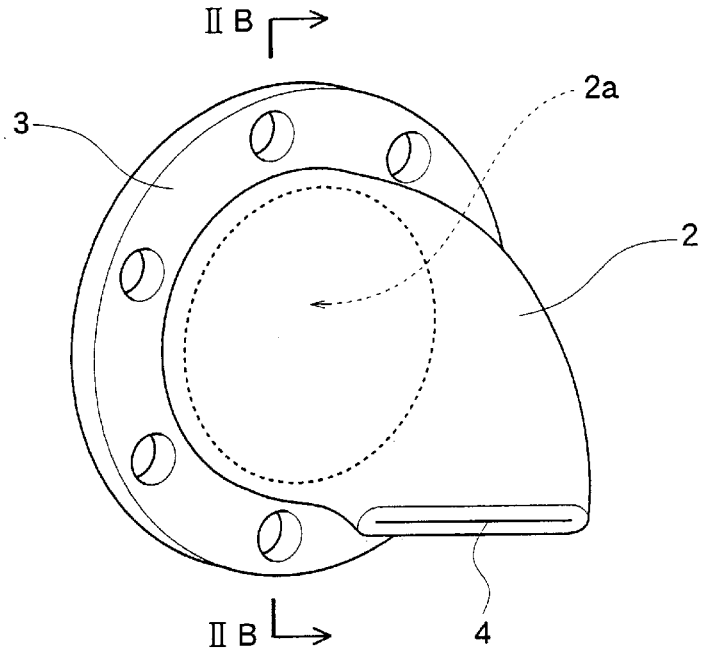
FIG. 2 (*a*) is a perspective view showing the exhaust outlet structure in FIG. 1, and FIG. 2 (*b*) is a sectional view taken along the line IIB—IIB in FIG. 2 (*a*)
Figure 2:
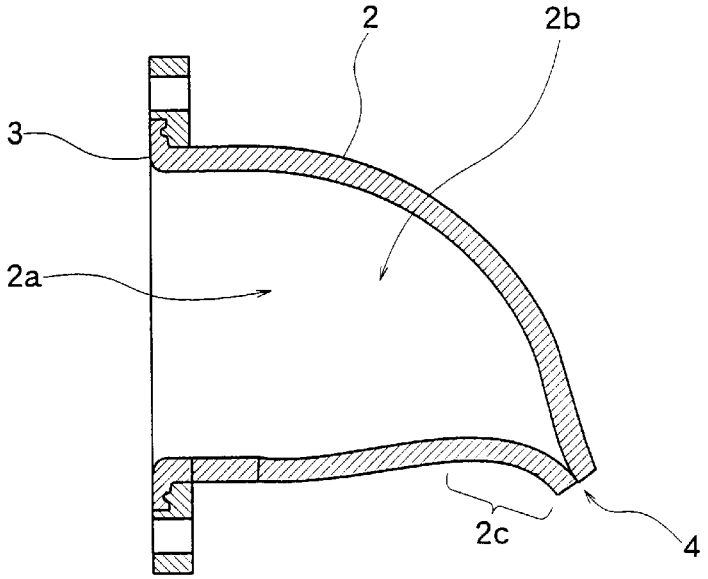

As shown in FIG. 2, the shut-off member 2 is formed to have a shape of a bent short pipe with one end thereof (an outlet end of the exhaust outlet structure) flatly pressed. A flange 3 to be fixed to a rear end face of the watercraft S is attached to an opening 2*a* on the other end side. The end side (outlet side) of the shut-off member 2 which has been flatly pressed is formed like a slit (hereinafter referred to as a slit 4). The slit 4 functions as an exhaust port. The shut-off member 2 is attached to the rear end of the hull H of the watercraft S (FIG. 1) in such a manner that the slit 4 is turned obliquely downward.

In consideration of heat resistance and corrosion resistance, nitrile rubber (NBR) or the like is usually employed as the flexible material forming the shut-off member 2. The slit 4 is substantially shut off based on a molding shape thereof if there is no difference between internal and external pressures of the shut-off member 2. If the internal pressure becomes higher than the external pressure, the slit 4 is opened against the elastic force of the surrounding flexible material depending on a differential pressure and a flow rate of an internal fluid.

Accordingly, the slit 4 is shut off when the engine of the watercraft S is stopped so that an exhaust gas is not generated, and the slit 4 is automatically opened due to the differential pressure when the engine is operated so that the exhaust gas is discharged. As a result, the water does not flow from the outside into the exhaust pipe through the shut-off member 2 during the stoppage of the engine. While the engine is being stopped, there is no cooling water which should be discharged together with the exhaust gas.

As shown in FIG. 2, a volume portion 2*b*, such as a bulge, is formed on the upstream side of the slit 4 of the shut-off member 2. Accordingly, if the water comes in contact with the volume portion 2*b* when the watercraft S planes on the water, the volume portion 2*b* is pushed from the outside (upward) by the force of the water flow. Consequently, the shut-off member 2 is distorted. The distortion spreads to the slit 4 so that the opening of the slit 4 is promoted. A top portion of the shut-off member 2 extending from the slit 4 toward the volume portion 2*b* will be hereinafter referred to as a lip portion 2*c*.

While the shut-off member 2 has been fixed to the rear end of the hull H by the flange 3, the present invention is not restricted thereto. For example, a fixing ring or the like may be used around the entrance side of the shut-off member 2 to fit the shut-off member 2 directly to the rear end of the second exhaust pipe Db (FIG. 1).

Since counterflow of the water (from the outside to the inside) can be effectively prevented by means of the shut-off member 2, the exhaust pipes Da Db and the inner portion of the water muffler M can be particularly simplified as shown in FIG. 1.

Figure 3:
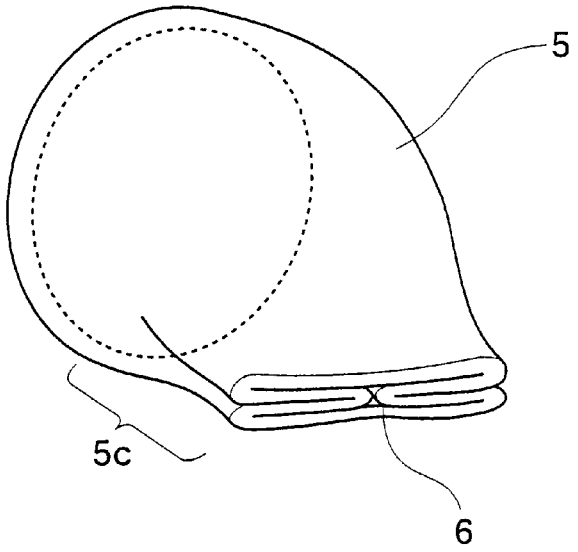
FIG. 3 (*a*) is a perspective view showing an exhaust outlet structure according to a second embodiment of the present invention, and FIG. 3 (*b*) is a perspective view showing the opening state of the exhaust outlet structure in FIG. 3 (*a*)
Figure 3:
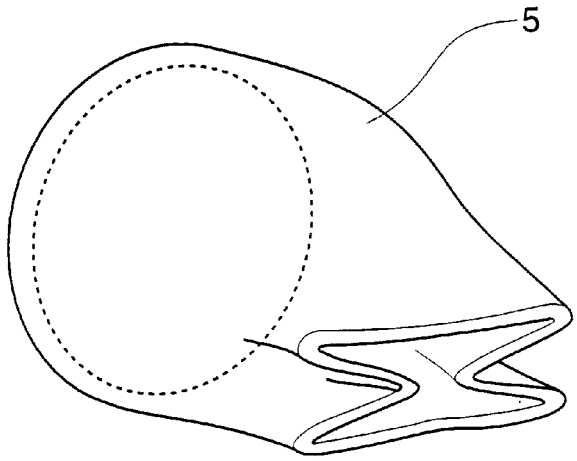

FIG. 3 shows a shut-off member 5 provided in an exhaust outlet structure according to a second embodiment. The shut-off member 5 has a slit 6 whose shape is different from the shape of the slit 4 of the shut-off member 2 (FIG. 2). More specifically, a side wall of the shut-off member 5 which reaches the slit 6, that is, a side face of a lip portion 5*c* is widely folded as it approaches the slit 6. The slit 6 is almost H-shaped in the shut-off state (see FIG. 3 (*a*)). Accordingly, when the flow rate of an exhaust gas is great, the slit 6 can be widely opened. In other words, the slit 6 can become a big opening with a transition from the H-shape to a hourglass (see FIG. 3 (*b*)), a rectangle and a circle. Furthermore, the shut-off member 5 itself has a small resistance to the opening, and can be opened easily.

While both side faces of the lip portion 5*c* have been folded to form a transverse H-shaped slit in the present embodiment, they are not particularly restricted to the same shape but may form a longitudinal H-shaped slit which is not shown in the drawings, that is, the slit 6 shown in FIG. 3 may be longitudinally formed by folding upper and lower walls of the lip portion.

Figure 4:
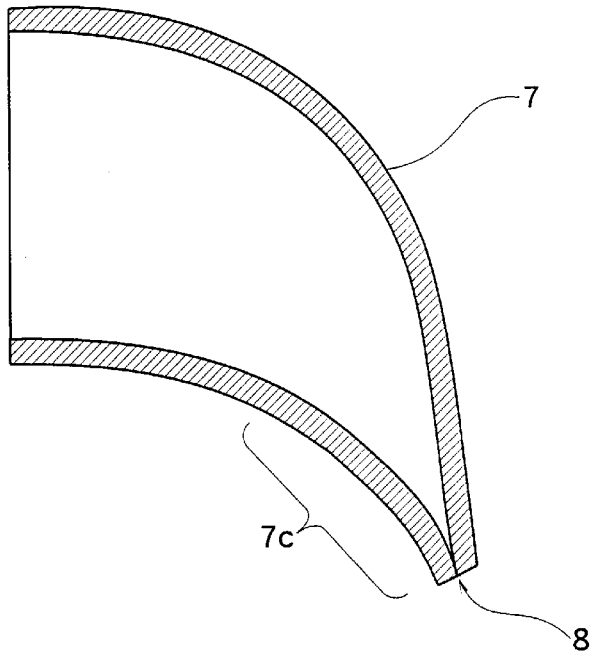
FIG. 4 is a sectional view showing an exhaust outlet structure according to a third embodiment of the present invention.

Since the shut-off member according to the present invention is formed of the flexible material, it can be easily molded to have a desired shape. As in a shut-off member 7 according to a third embodiment shown in FIG. 4, for example, a lip portion 7*c* can have a downwardly extended shape such that a slit 8 is provided in a lower position. Consequently, the slit 8 approaches or plunges into the water surface during use so that the generation of reflected sounds by an exhaust gas can be reduced. In addition, the opening promotion effect of a water flow can be enhanced.

Figure 5:
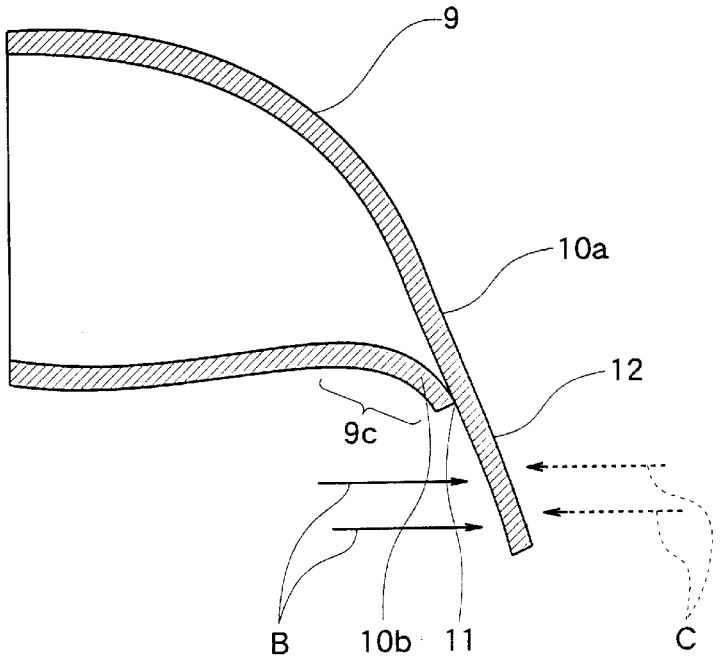
FIG. 5 is a sectional view showing an exhaust outlet structure according to a fourth embodiment of the present invention.

A shut-off member 9 according to a fourth embodiment shown in FIG. 5 has a structure in which an upper side wall 10*a* forming a lip portion 9*c* is extended more greatly than a lower side wall 10*b* obliquely downward. Accordingly, a slit 11 is formed by a portion between an edge of the lower side wall 10*b* and the upper side wall 10*a* which are in contact with each other. A portion of the upper side wall 10*a* which is extended more greatly than the edge of the lower side wall 10*b* will be hereinafter referred to as a contact piece 12. By such a structure, when the watercraft S (FIG. 1) planes on the water, a water flow B pushes a lower portion of the contact piece 12 rearward if the shut-off member 9 is positioned in the water, and an air flow pushes the lower portion of the contact piece 12 rearward if the shut-off member 9 is positioned in the air. Therefore, the opening of the slit 11 is promoted. On the other hand, in the case where waves act in a rear portion of a watercraft S as shown by an arrow C in FIG. 5, the waves push the contact piece 12 forward. Consequently, the shut-off effect of the slit 11 can be enhanced so that the waves or the like can be prevented from flowing into the shut-off member 9. In this case, if the slit 11 has the same H-shape as in the slit 6 of the shut-off member 5 (FIG. 3), the slit 11 can be effectively opened.

Figure 6:
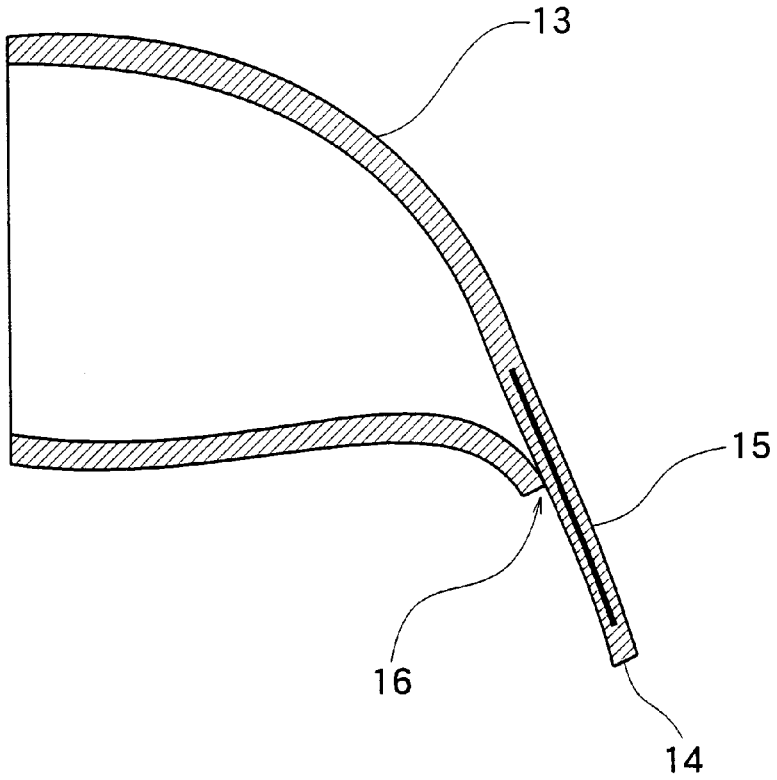
FIG. 6 is a sectional view showing an exhaust outlet structure according to a fifth embodiment of the present invention.

A shut-off member 13 having a contact piece similar to shut-off member 5 according to a fifth embodiment is shown in FIG. 6. In this embodiment the shut-off member 13 is formed by burying a core plate member 15 in a contact piece 14 portion. It is sufficient that the core plate member 15 is made of a material having a higher rigidity than a flexible material of the shut-off member 13. For example, hard synthetic resin, metals and the like can be employed as the material of the core plate member 15.

By the existence of the core plate member 15, the contact piece 14 can tightly receive a water flow or an air flow, and can promote the opening of a slit 16 without bending. A portion where the core plate member 15 should be buried is not strictly restricted to the contact piece 14 portion. It is preferable that the core plate member 15 should be extended to a slightly upstream position of the contact piece 14. The core plate member 15 is not restricted to the plate shape but may be formed by burying a large number of bar-shaped members such that their axial directions are set in the upstream and downstream directions.

In place of the core plate member 15, the contact piece 14 portion and the slightly upstream portion may have greater thicknesses than in other portions of the shut-off member 13 to increase spring constants or may have a higher elastic modulus than the elastic modulus of the flexible material forming the shut-off member 13.

While all the shut-off members 2, 5, 7, 9 and 13 have had volume portions, the present invention is not particularly restricted to such a structure.

Figure 7:
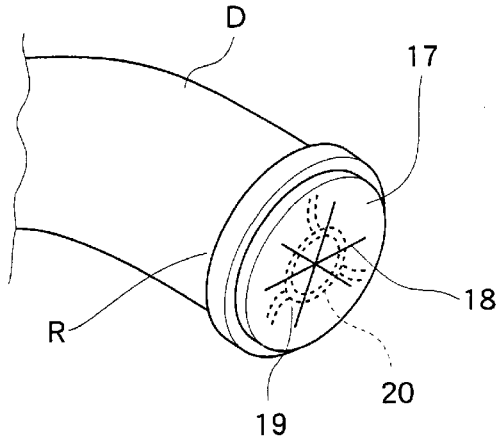
FIG. 7 (*a*) is a perspective view showing an exhaust outlet structure according to a sixth embodiment of the present invention, and FIG. 7 (*b*) is a perspective view showing the opening state of the exhaust outlet structure in FIG. 7 (*a*), and FIG. 7 (*c*) is a perspective view showing another type of an exhaust outlet structure having the same engaging construction as that of FIG. 7 (*a*)
Figure 7:
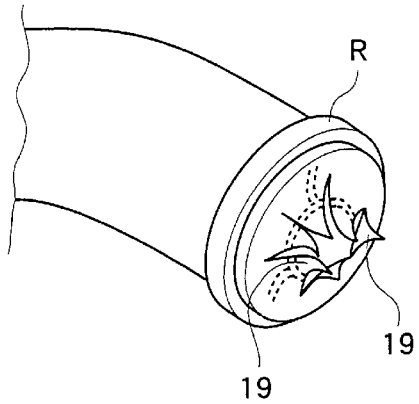
Figure 7:
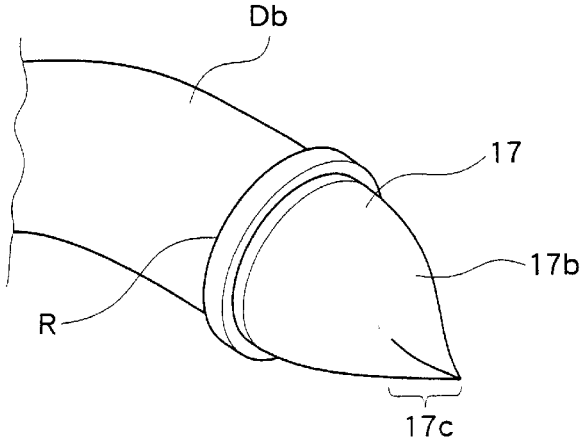
Figure 8:
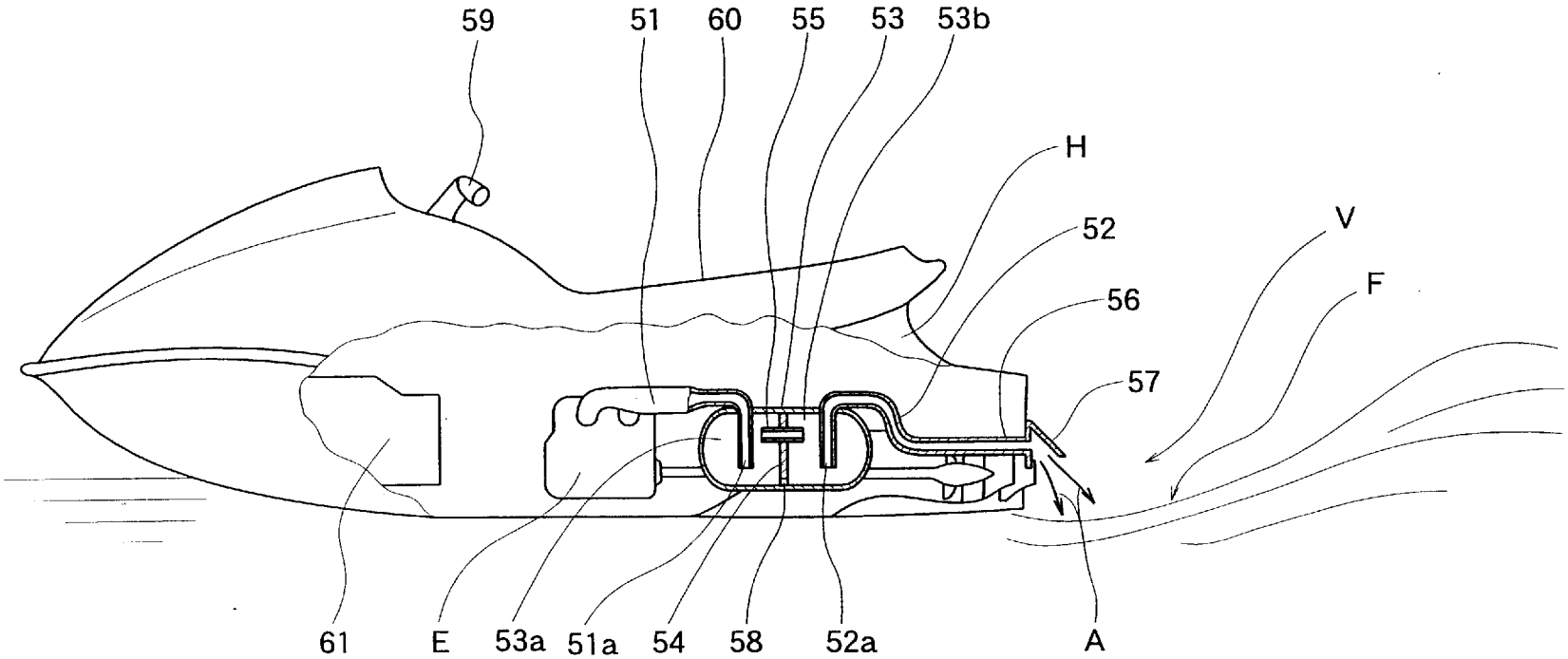
Fig.8 PRIOR ART
FIG. 8 is a partially sectional side view showing an example of a personal watercraft having an exhaust outlet structure according to the prior art.

As a sixth embodiment shown in FIG. 7, a film-shaped shut-off member 17 can also be used. The shut-off member 17 can be mounted on a flange (not shown) to be fixed to a rear end of a watercraft S or a ring R to be fixed to a rear end of a second exhaust pipe Db. In that case, it is preferable that a rear portion of the second exhaust pipe Db is inclined rearward and obliquely downward as shown in order to prevent reflected sounds. While, as shown in FIG. 7 (*c*) a lip portion 17*c* having a slit may be formed on the film-shaped shut-off member 17, cuts 18 which mutually intersect may be formed on the shut-off member 17 as shown in FIG. 7 (*a*). The cuts 18 form an exhaust port. Consequently, a plurality of triangular pieces 19 formed between the cuts 18 are bent outward by an internal pressure of the second exhaust pipe Db so that the exhaust port is opened like a star (see FIG. 7 (*b*)). Accordingly the shut-off member 17, the exhaust port can be opened still more easily. By increasing the length and number of the cuts 18, the opening can be more readily performed.

A ring member 20 may be provided in the second exhaust pipe Db as shown such that the triangular piece 19 is not bent toward the inside of the second exhaust pipe Db, so that a water counterflow can be prevented.

Furthermore, a volume portion 17*b* may be provided in the shut-off member 17, as shown in FIG. 7 (*c*).

Numerous modifications and alternative embodiments of the present invention will be apparent to those skilled in the art in view of the foregoing description. Accordingly, this description is to be construed as illustrative only, and is provided for the purpose teaching those skilled in the art the best mode of carrying out the invention. The details of the structure and/or function may be varied substantially without departing from the spirit of the invention and all modifications which come within the scope of the appended claims are reserved.

What is claimed is:

1. An exhaust outlet structure for a personal watercraft which serves to discharge an exhaust gas of an engine mounted on the personal watercraft, the exhaust outlet structure comprising:

a shut-off member provided on a rear end of an exhaust passage and formed of a flexible material;

an exhaust port formed at the shut-off member, which is capable of being elastically shut off and being opened by external force; and said shut-off member extending rearward and downward and including upper and lower side walls which come in contact with each other, and a portion between the upper and lower side walls forming the exhaust port.

2. The exhaust outlet structure for a personal watercraft according to claim 1, wherein the upper side wall is extended more greatly than the lower side wall rearward and downward.

3. The exhaust outlet structure for a personal watercraft according to claim 1, wherein the shut-off member includes a volume portion in an upstream part of the exhaust port.

4. The exhaust outlet structure for a personal watercraft which serves to discharge an exhaust gas of an engine mounted on the personal watercraft, the exhaust outlet structure comprising:

a flexible shut-off member having a free end and provided on a rear end of an exhaust passage and formed of a flexible material;

an exhaust port formed at the free end of the flexible shut-off member, said exhaust port capable of being elastically shut-off and being opened by external force; and said flexible shut-off member includes a formed volume portion defined within said flexible shut-off member between said exhaust port and said exhaust passage rear end and upstream of the exhaust port.

* * * * *